US010350649B1

(12) United States Patent
Dailey, III

(10) Patent No.: US 10,350,649 B1
(45) Date of Patent: Jul. 16, 2019

(54) MANUFACTURED CLOTH WIPERS

(71) Applicant: Intex DIY, Inc., Villa Rica, GA (US)

(72) Inventor: Robert W Dailey, III, Villa Rica, GA (US)

(73) Assignee: INTEX DIY, INC., Villa Rica, GA (US)

( * ) Notice: Subject to any disclaimer, the term of this patent is extended or adjusted under 35 U.S.C. 154(b) by 226 days.

(21) Appl. No.: 15/438,369

(22) Filed: Feb. 21, 2017

Related U.S. Application Data

(60) Provisional application No. 62/298,806, filed on Feb. 23, 2016.

(51) Int. Cl.

| | |
|---|---|
| ***B08B 3/04*** | (2006.01) |
| ***D04H 1/492*** | (2012.01) |
| ***B08B 1/00*** | (2006.01) |
| ***B65B 5/06*** | (2006.01) |

(52) U.S. Cl.
CPC ..... *B08B 3/04* (2013.01); *B08B 1/006* (2013.01); *B65B 5/06* (2013.01); *D04H 1/492* (2013.01)

(58) Field of Classification Search
CPC .. A47K 2010/3266; B08B 3/04; B08B 1/006; B65B 5/06; B65B 5/00; D06F 35/00; D04H 1/492; D04H 3/11; D04H 1/49; D04H 5/03; D04H 1/26
See application file for complete search history.

(56) References Cited

U.S. PATENT DOCUMENTS

| | | | | |
|---|---|---|---|---|
| 2,689,642 | A * | 9/1954 | Franke | B65B 27/12 100/38 |
| 4,931,355 | A * | 6/1990 | Radwanski | D04H 5/02 28/104 |
| 6,022,818 | A | 2/2000 | Welchel et al. | |
| 10,106,920 | B2 * | 10/2018 | Zhang | A47L 1/15 |
| 2003/0116464 | A1 * | 6/2003 | Koenig | A01K 13/001 206/494 |
| 2008/0248239 | A1 * | 10/2008 | Pomeroy | B65H 37/04 428/121 |
| 2015/0075118 | A1 * | 3/2015 | Pearson | B30B 9/3003 53/452 |
| 2016/0194789 | A1 * | 7/2016 | Zhang | A47L 1/15 28/143 |

FOREIGN PATENT DOCUMENTS

| | | | | |
|---|---|---|---|---|
| CN | 106192375 | A * | 12/2016 | |
| EP | 2003236 | A2 * | 12/2008 | D06F 35/00 |
| WO | WO-2014101261 | A1 * | 7/2014 | A47L 1/15 |

* cited by examiner

*Primary Examiner* — Jennifer A Steele
(74) *Attorney, Agent, or Firm* — Kevin E Flynn; Flynn IP Law

(57) ABSTRACT

Creating a set of manufactured cloth wipers from a set of cut sheets made from a non-woven substrate that has wood-pulp fibers hydroentangled with polyester. Saturating the set of cut sheets to a mixture of a mildew inhibitor and fabric softener and water. Removing water from the cut sheets with a water extractor and then partially drying the cut sheets in a dryer. Optionally, compressing a set of semi-dry cut sheets into a tightly compressed block; and placing the compressed block into a shipping container that allows for additional drying of the compressed block of cut sheets.

22 Claims, 2 Drawing Sheets

MANUFACTURED CLOTH WIPERS

This application claims the benefit of and incorporates by reference U.S. Provisional Patent Application No. 62/298,806 filed Feb. 23, 2016.

BACKGROUND

Field of the Disclosure

This disclosure relates generally to the production of a cloth-like wiping rag, in particular manufactured cloth wipers. These rags or wipers are a staple used by painters and for cleaning rags. Typical uses of paint and cleaning rags are for a variety of tasks involving water, paint, grease, oil and solvents; including paint clean-up, staining, cleaning, polishing, dusting, and drying.

Historically, rags used for these purposes came from recycled old clothes that were cut into rags. These rags were not particularly attractive to consumers due to the potential safety and health hazards associated with the reclamation of used clothing including things such as cleanliness and sanitation issues, buttons, collar stays, et cetera and the lack of consistent controls in cottage processing plants where clothing is graded, sorted and cut into wiping size pieces.

Another source for rags was waste fabric from clothing factories. As the textile manufacturing industry moved away from the United States into foreign countries in Central America and the sub-continent of Asia, so did the supply sources for textile waste from knitting or weaving mills and cut and sew factories where clothing is made from new fabric.

The greatest challenge with rags made from both new fabric waste and reclaimed clothing has always been the inherent inconsistency in fabric type, size, weight, absorbency and color of the waste fabrics from which rags are sorted and cut. This is exacerbated by the fact that the sorting and cutting is done in source countries. Due to the inconsistency and nature of processing textile waste, rags have traditionally been packaged in resale units based upon weight, with no certainty to the purchaser of piece count or size. Since rags are used by the piece, not by the pound, one never really knows how many uses or how long a package of rags will last. Since fabric waste is dictated by prime clothing manufacturing, the various grades of fabrics available in the waste stream are totally dependent upon fashion and clothing trends. With the move of global textile manufacturing, (especially T-shirt knit, the most preferred cloth grade for consumer paint and cleaning rags) now predominantly shifted to countries like Bangladesh and Pakistan, additional challenges plague the supply chain of new fabric waste including, socio-political issues, ocean freight, and increased competition for supply from countries closer to the source of the waste like Japan, Australia and Indonesia. In addition, the total supply of new waste available is never quite predictable and is affected by seasonality, natural disasters, economic conditions and continual process improvements in textile manufacturing designed to decrease waste.

A relatively new entry into the rag market is wiping cloths made from fresh textile fabric manufactured in consistent size and fabric type. These items are called manufactured cloth wipers and sometimes known as "exact-cuts" or "zero-waste".

SUMMARY OF THE DISCLOSURE

The present disclosure teaches the production of improved manufactured cloth wipers. The disclosed process produces manufactured cloth wipers that are superior to rags made from new textile seconds or reclaimed used clothing. The improved manufactured cloth wipers may be made from 50% natural fibers hydro-entangled with strong polymer filaments, and designed to have cloth-like properties of hand feel, strength, durability and super-absorbency. The improved manufactured cloth wipers eliminate the inconsistencies associated with textile cloth rags and offer superior benefits of low lint, high absorbency, solvent resistance, lower cost per piece, consistent piece size and shape, and packaged by wiper count, not weight. The fabric is lighter in weight than traditional cloth wiper rags but is strong and pliable for precision wiping performance on smooth surfaces and in tight corners; and also makes handling easier.

The teachings of the present disclosure may be used to create improved manufactured cloth wipers that are absorbent and durable in water, paint, stain, grease, oil and common solvents. The process may be scaled to make manufactured cloth wipers in a desired size. A user may choose to set up manufacturing processes to make one size manufactured cloth wiper and one or more larger sizes of manufactured cloth wipers.

Using hydro-entangled non-woven substrate means that the product is created using water jets and does not rely on a glue or bonding agent. Thus, the product is not sensitive to solvents. Rolls of non-woven material are slit and cut into sheets of a prescribed size and shape. A mildew inhibitor and fabric softener in mixed in a solution of water and the cut sheets are exposed to this solution. After compete saturation, the water is drained and then wet pieces of the non-woven substrate are spun to extract more water from the sheets to leave them damp rather than dripping wet. After water is extracted, the sheets are substantially, but not totally dried in a dryer. The substantially dried sheets dry further as they are shipped in air permeable containers. Optionally, the collection of sheets is compressed for shipping.

Aspects of the teachings contained within this disclosure are addressed in the claims submitted with this application upon filing. Rather than adding redundant restatements of the contents of the claims, these claims should be considered incorporated by reference into this summary.

This summary is meant to provide an introduction to the concepts that are disclosed within the specification without being an exhaustive list of the many teachings and variations upon those teachings that are provided in the extended discussion within this disclosure. Thus, the contents of this summary should not be used to limit the scope of the claims that follow.

Inventive concepts are illustrated in a series of examples, some examples showing more than one inventive concept. Individual inventive concepts can be implemented without implementing all details provided in a particular example. It is not necessary to provide examples of every possible combination of the inventive concepts provide below as one of skill in the art will recognize that inventive concepts illustrated in various examples can be combined together in order to address a specific application.

Other systems, methods, features and advantages of the disclosed teachings will be immediately apparent or will become apparent to one with skill in the art upon examination of the following figures and detailed description. It is intended that all such additional systems, methods, features and advantages be included within the scope of and be protected by the accompanying claims.

BRIEF DESCRIPTION OF THE FIGURES

The disclosure can be better understood with reference to the following figures.

DETAILED DESCRIPTION

Process of Making Manufactured Cloth Wipers

Figure 1:
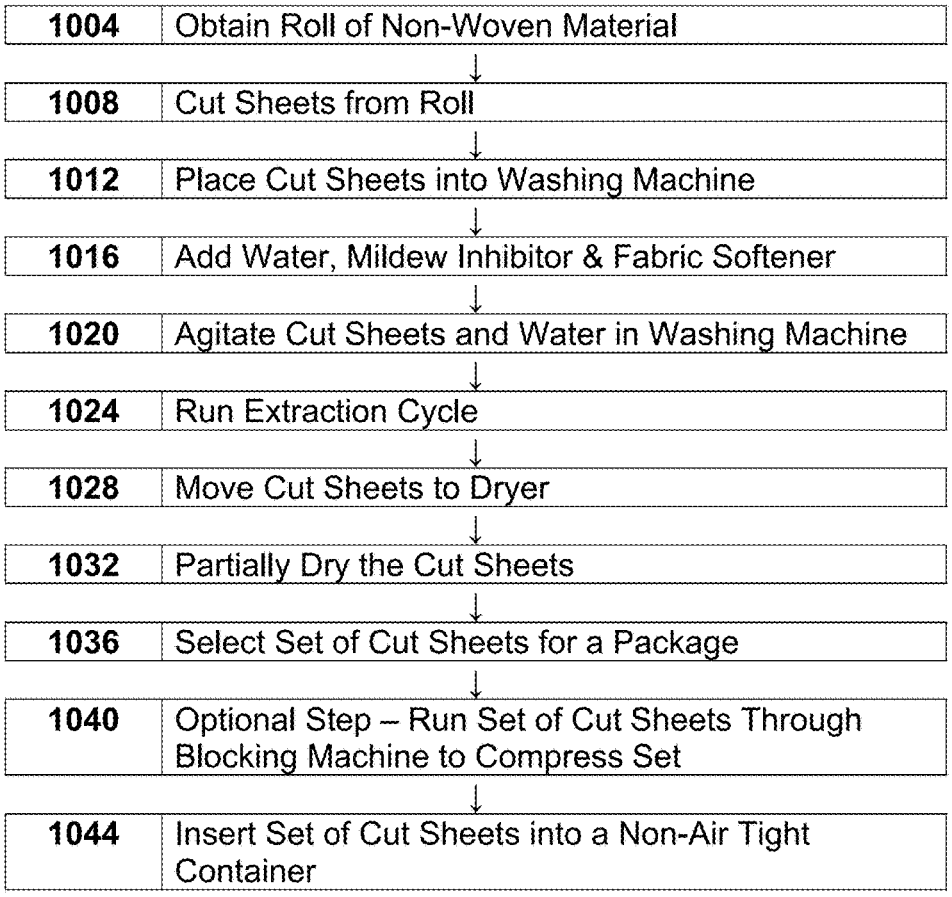
FIG. 1 is a flow chart of a process to make manufactured cloth wipers.

FIG. 1 has a high level summary of the process 1000 for making manufactured cloth wipers as set forth in more detail below.

Step 1004—Obtain a roll of non-woven material. A preferred material is a hydro-entangled non-woven substrate made of 50% wood pulp and 50% embedded polymer and without any binder material. The hydroentanglement process is frequently called spunlacing. A preferred embedded polymer is industrial grade polyester, although medical grade polyester may be used. Wood pulp made from Canadian hardwood has produced a desirable substrate. Those of skill in the art will recognize that metric associated with non-woven substrates is the weight of the material per unit area. A common designation is grams per square meter (GSM). Typically a 50/50 wood/polyester hydro-entangled substrate would have a weight of 65 to 72 GSM. However, the process to produce manufactured cloth wipers preferably uses 50/50 wood/polyester hydro-entangled substrate that is approximately 90 GSM or more. Successful production of suitable manufactured wiper cloths has occurred with non-woven material with an initial GSM of 89. It is possible that one of skill in the art could reduce the agitation treatment and have a viable product that starts with a substrate that is 85 GSM. The target may be set at 92 GSM so that even with variation of plus or minus 2 GSM, the GSM of the raw material is at least 90 GSM. Those of skill in the art will recognize that highly absorbent material will absorb moisture from ambient humidity which may alter the GSM away from a target number by as much as plus or minus 2 GSM.

Examples of suitable suppliers that can provide a wood pulp/polyester non-woven material with the desired weight include Youngrowth Group Inc. of Stockton Calif. and Sontara Old Hickory Inc. of Nashville, Tenn. This list is not intended to be exhaustive.

The incoming material may be checked to ensure that it has the desired weight of material per unit area. The material may have a weight per unit area in the range of 92 GSM. Depending on the intended purpose of the manufactured cloth wipers, the preferred weight per unit area may be different.

Step 1008—Non-woven material is cut from parent roll of material to a desired size. The parent roll may be wider than the desired sheet size. For example the roll width may be approximately 41.3 inches wide, 50 inches wide or some other width. An example of a sheet size may be a sheet in the size range of 13.7 inches by 15 inches, or 13.7 by 12 inches or some other size. Frequently the size of the sheet will be selected so that the full width is used on the former equipment used to create the non-woven material, but this is not a requirement of the process. The specific process used to cut the sheets is not critical to the teachings of the present disclosure as non-woven material of this type is not prone to fraying like a woven material. The cutting process will need to cut rather than attempt to tear this material. A non-woven material sheeter may be obtained from a source such at Kete Group Limited (see http://www.ketegroup.com/html/en/).

Those of skill in the art will appreciate that a facility that creates manufactured cloth wipers could acquire cut sheets from a third-party instead of a roll of non-woven material. The material could be cut into sheets immediately after the former create the hydroentangled non-woven material or the two processes can be decoupled by rewinding the non-woven material after the former and then later cutting the non-woven material into sheets.

Step 1012—Cut sheets are placed into a washing machine. When using a front loading washing machine, the sheets would be placed in before the water is added but this would not be required for a top loading machine. If needed the sheets may be sprayed with a small amount of water to help with the loading process but this is not required and is only a small amount of water when used.

Step 1016—Add water and mildew inhibitor/fabric softener. The appropriate amount of mildew/fabric softener for a volume of water will vary depending on the choice of mildew inhibitor and fabric softener. The use of mildew inhibitor is necessary to prevent the formation of mold or mildew on the manufactured cloth wipers after packaging as the residual moisture will support growth. Fabric softener is not required, but is desired as this helps the process lead to a softer cloth-like wiper. An example of the quantities is 90 milliliters of additive to 374 gallons of water. This quantity of water may be used with a set of 20,000 to 25,000 sheets that are 13.7 inches by 15 inches, or 13.7 by 12 inches.

The mildew inhibitor/fabric softener may be added to the washing machine after the washing machine has been filled or at least substantially filled with the amount of water used for the wash cycle. Alternatively, the mildew inhibitor/fabric softener may be added to the water to be used to fill the washing machine.

While those of skill in the art would be able to qualify another additive, a suitable additive to provide mildew inhibitor and fabric softener is available as Sani-Soft a concentrated fabric softener/sanitizer that acts as a fungicide. (See http://www.pariserchem.com/files/SANI-SOFT.pdf).

Step 1020—Wash cycle causes the sheets to be saturated with the water and mildew/inhibitor/fabric softener. The water used in the process may be unheated which will generally be in the range of 60 degrees Fahrenheit.

While the cut sheets are not dirty and do not need agitation within the washing machine to release dirt, agitation of the cut sheets within the washing machine is helpful in promoting a cloth-like texture. Agitation helps ensure distribution of the additive to all cut sheets. In a front loaded washing machine, agitation is provided by slowly rotating the contents of the washing machine around a horizontal axis to lift and drop the contents of the washing machine. Ribs extending radially inward from the washing machine drum walls serve to lift and drop the cut sheets.

The desired duration of agitation will be a function of the type of washing machine used, the relative fullness of the machine and the non-woven material that is used. Excessive agitation leads to visible damage to a fraction of the cut sheets.

To provide an example of the agitation duration for a front loaded washing machine, a wash cycle has been used with a one minute fill period, followed by a three minute soak period and a twelve minute agitation cycle. While an agitation period of twelve minutes has been found suitable, the appropriate duration will vary with the type of washing machine used, the loading, and the GSM weight of the cut sheets.

Step 1024—Extraction cycle is run to remove excess water. The extraction cycle is the same process as a spin cycle in a home clothes washing machine. After washing of the cut sheets, the water is drained from the washing machine. The extraction cycle follows while the wet cut sheets are still in the washing machine. Rapid spinning of the contents forces water out holes in the spinning drum and away from the cut sheets. The cut sheets after the extraction cycle should be damp but not wringing wet. Having the sheets excessively wet would require additional time in the dryer. A set of cut sheets that are dripping wet may have water in excess of 81% of the weight of sheets before wetting. A sheet that has been wrung out by hand may still have water at the level of 70% of added weight relative to a sheet before wetting. An effective extraction cycle can bring the water weight down to 50-55% of the weight of the set of sheets before wetting.

Step 1028—Move the cut sheets from the washing machine to a dryer. The dryer is sized to receive the output from the washing machine. Thus, the dryer is sized to receive the entire lot of 20,000 to 25,000 sheets.

Step 1032—Dry the sheets to take the water content down to under 15% added water by weight as compared to the weight of the sheets before the laundry process. A target range may be an increase in weight from water of five to seven percent but water contents of up to 15% by weight are acceptable. An increase in weight of more than 15% from water will provide a useful manufactured cloth wiper but the manufactured cloth wiper may still feel damp when removed from the container and the end user may worry that the dampness may impact use when used in a process such as staining rather than simply to clean up spilled material.

The drying process is not intended to remove all of the water acquired during the earlier wetting step. Leaving the manufactured cloth wipers with some water content causes the manufactured cloth wipers to receive and retain wrinkles imposed when compressing the set of manufactured cloth wipers. These wrinkles are not defects in the product as they help the manufactured cloth wipers have a cloth-like appearance to end users.

A secondary benefit of keeping some level of moisture in the manufactured cloth wipers is to protect the manufactured cloth wipers from the negative effects of over-drying including changes in appearance and softness of the manufactured cloth wipers. Over-dried cut sheets can feel hard and rough.

A drying cycle that has been found effective is 30 minutes at 215 to 220 degrees Fahrenheit. Followed by 20 minutes at 195 to 200 degrees Fahrenheit, followed by a 15 minute cooldown cycle where no additional heat is provided.

A sample of sheets may be taken and weighed and compared with the calculated weight for the same number of sheets before washing. If the water weight percentage is above a desired upper limit, the lot of sheets may undergo another short drying cycle. A short drying cycle may be another 10 minutes at 195 to 200 degrees followed by another cooldown cycle to bring the water content into the desired range. The dryer may be set to reverse the direction of rotation every four minutes or so. One of skill in the art will recognize that the ambient air in industrial facilities will differ in humidity over time and this impacts the drying capacity of the industrial dryers. One of skill in the art will recognize that the drying cycle lengths are going to be a function of the number and size of the cut sheets that are in the lot and to some extent the length of the extraction cycle.

While having a water content sufficient to allow creases to be imposed during the blocking process is desirable to give another cloth-like characteristic to the manufactured cloth wipers, it is not absolutely required in order to enjoy at least some of the benefits of the present disclosure. A careful drying process could be used to bring the weight gain of the cut sheets to close to zero percent. The cut sheets will have received the mildew inhibitor and the fabric softener. The agitation imposed during the washing and drying cycles will have altered the feel of the cut sheet from stiff sheets to something like a cotton T-shirt.

Step 1036—A desired number of sheets are selected for a package. This may be done by counting the sheets or by adding sheets until the weight of the sheets is within a range that indicates the proper number of sheets is present.

Step 1040—The set of sheets may be run through a blocking machine and then inserted into a bag for retail sale. The reduction of volume from a loose set of manufactured cloth wipers to a compressed block of manufactured cloth wipers may be significant, perhaps approaching a 50% reduction in volume. The manufactured cloth wipers may be produced for specific retailers that have their individual preferences for specific sizes and shapes of the packaged product. A suitable block machine is a High-Speed Textile Packing System sold by Daptech LLC of Wichita, Kans.

Step 1044—The bag with inserted set of blocked sheets is sealed. The bag while sealed to prevent the manufactured cloth wipers from leaving the bag is not air tight. The manufactured cloth wipers can continue to dry as the bag will have a set of one or more openings to allow for air flow. For example the bag may have four holes near the top of the bag that are approximately a quarter inch in diameter. The addition of a mildew inhibitor protects the manufactured cloth wipers from mildew as the manufactured cloth wipers continue to dry after packaging.

Figure 2:
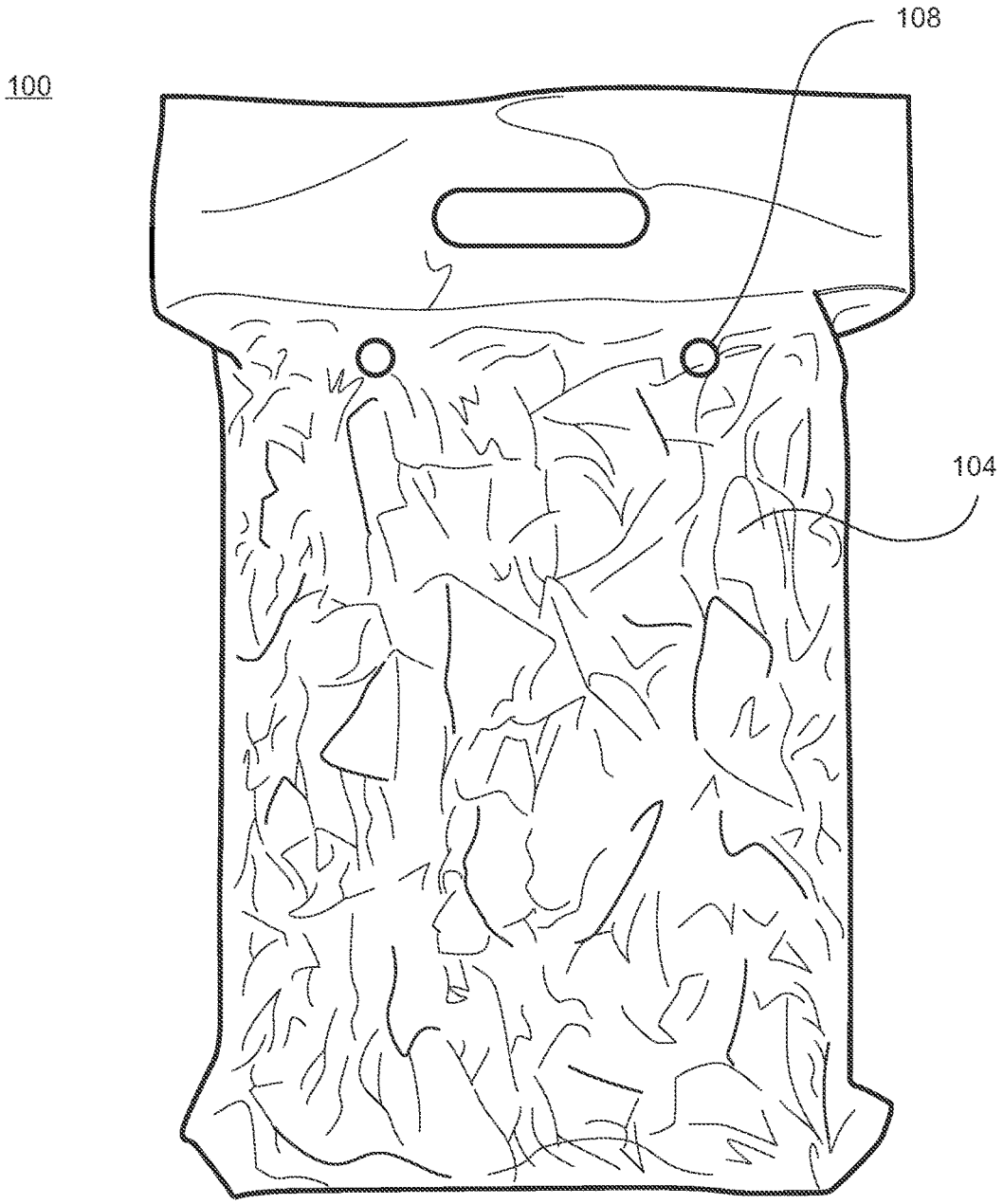
FIG. 2 is a an example of a bag of fifty manufactured cloth wipers after the process set forth in FIG. 1 including the blocking step.

FIG. 2 shows a bag 100 with a set of fifty manufactured cloth wipers 104 after the process 1000 set forth in FIG. 1, including the use of a blocking machine to compress a set of manufactured cloth wipers with residual water content to impress a set of creases upon the set of manufactured cloth wipers. One can see that the outward appearance of the set of manufactured cloth wipers 104 appears to be a set of lightweight woven cotton rags. This appearance would be appealing to a painter or other person seeking rags for wiping. A set of four breather holes 108 promote airflow but two of the breather holes are on the back side of bag 100 and not visible here. The breather holes 108 have been added to this prototype bag and are not necessarily to scale.

Alternatives and Variations.

Alternative Non-Woven Materials.

The example set forth above used a 50/50 wood pulp/polyester without binder. Other non-woven materials may be used. In place of the absorbent fiber, wood pulp, one can use cotton. While cotton produces a desirable product, it can be more expensive than wood pulp. Another substitute for the wood pulp is viscose rayon, frequently called simply viscose.

The hydroentanglement process makes a composite material by entangling the absorbent fibers such as the wood pulp with a matrix fiber which serve to temporarily hold fluids and transfer them to the absorbent fibers. The matrix fibers may be hydrophilic or hydrophobic fibers. The matrix fibers help provide strength the manufactured cloth wipers. While polyester is a suitable matrix fiber, other polymer substances known to those of skill in the art may be used. Polypropylene fibers are a suitable polymer for use as matrix fibers.

The suggested weight of the non-woven fabric of wood pulp and polyester was in the range of 92 GSM. The appropriate weight for non-woven fabric made from other combinations of absorbent fiber and matrix fiber may be different. Those of skill in the art will be able to take the teachings of the present disclosure and test non-woven fabrics of different weights to select a weight of non-woven fabric that tolerates the conditioning processes set forth above and has a satisfactory cloth-like feel to a user.

While a 92 GSM target weight for a wood pulp/polyester non-woven material is suitable for use with the teachings of the present disclosure, a heavier weight non-woven may be used. A wood pulp/polyester hydroentangled non-woven material with a weight of 110 GSM produced a suitable manufactured cloth wiper and it is believed that even heavier weights would provide a suitable manufactured cloth wiper but the added cost may not be justified for wiper rags.

Alternative Packaging.

While the process set forth above took a set of manufactured cloth wipers through a blocking machine and then put the compressed block of manufactured cloth wipers into a plastic bag with air breather holes before sealing the bag, this is not a requirement of the process. Other packaging options exist.

The compression from the blocking machine is desirable in that the blocking introduces creases (wrinkles) into the manufactured cloth wipers and the creases are retained as the manufactured cloth wipers continue to dry after packaging. End users see the wrinkles as an additional indication that this is a cloth-like material. However, the manufactured cloth wipers are functional without the compression from the blocking machine. Thus, manufactured cloth wipers may be placed into an appropriately sized bag with breather holes and sealed.

Another alternative is that the manufactured cloth wipers may be placed into a box that is sealed. The box will naturally allow some level of air flow so that the manufactured cloth wipers continue to dry. Selecting a box size for a set of manufactured cloth wipers that requires some compression of the set of manufactured cloth wipers in order to fit the entire set into the box may help provide the desired set of random creases in the manufactured cloth wipers.

Alternative Soak.

While the process set forth above teaches the use of an agitation cycle within the washing machine, manufactured cloth wipers may be made by soaking the cut wipers in a water solution having the mildew inhibitor and fabric softener followed directly by a water extraction cycle. While the agitation is preferred especially with the non-woven material having a heavy weight in the range of 92 GSM, a process without agitation may be suitable for a lighter weight non-woven material.

One of skill in the art will recognize that some of the alternative implementations set forth above are not universally mutually exclusive and that in some cases additional implementations can be created that employ aspects of two or more of the variations described above. Likewise, the present disclosure is not limited to the specific examples or particular embodiments provided to promote understanding of the various teachings of the present disclosure. Moreover, the scope of the claims which follow covers the range of variations, modifications, and substitutes for the components described herein as would be known to those of skill in the art.

The legal limitations of the scope of the claimed invention are set forth in the claims that follow and extend to cover their legal equivalents. Those unfamiliar with the legal tests for equivalency should consult a person registered to practice before the patent authority which granted this patent such as the United States Patent and Trademark Office or its counterpart.

What is claimed is:

1. A process to create a manufactured cloth wiper, the process comprising:

obtaining a set of more than one clean, unused wiper sized sheets of made of a hydroentangled substrate of absorbent fiber and embedded polymer;

washing the wiper sized sheets in water with a mildew inhibitor; the step of washing including agitation of the wiper sized sheets followed by draining the water and mechanically extracting water from the wiper sized sheets;

creating partially dried wiper sized sheets by drying the wiper sized sheets while the wiper sized sheets tumble within a dryer;

selecting a shipping set of partially dried wiper sized sheets that is a set of at least two partially dried wiper sized sheets for shipment within a single shipping container;

compressing in aggregate the shipping set of partially dried wiper sized sheets to impose wrinkles into the partially dried wiper sized sheets;

packaging the shipping set of partially dried wiper sized sheets as manufactured cloth wipers in a shipping container that is not air tight so that the partially dried wiper sized sheets can continue to dry while protected with mildew inhibitor; and wherein the shipping container contains manufactured cloth wipers that have wrinkles and a cloth-like appearance and softer feel than the set of more than one clean, unused wiper sized sheets made of the hydroentangled substrate used as inputs to this process.

2. The process of claim 1 wherein the embedded polymer is polyester.

3. The process of claim 1 wherein the embedded polymer is polypropylene.

4. The process of claim 1 wherein the wiper sized sheet has an area between one square foot and two square feet.

5. The process of claim 1 wherein the process includes cutting a roll of hydroentangled substrate to form the wiper sized sheets.

6. The process of claim 1 wherein the shipping container is a box that receives a set of partially dried wiper sheets.

7. The process of claim 1 wherein the washing of the wiper sized sheets in water uses a fabric softener in addition to the mildew inhibitor.

8. The process of claim 7 wherein the step of washing the wiper sized sheets in water with the mildew inhibitor and the fabric softener includes the step of adding water to a washing machine, then adding the mildew inhibitor and fabric softener to the water and set of wiper sized sheets during a soak cycle that precedes agitation of the wiper sized sheets by rotating a drum portion of the washing machine.

9. The process of claim 1 wherein the hydroentangled substrate is made using absorbent fiber that includes cotton.

10. The process of claim 1 wherein the hydroentangled substrate is made using absorbent fiber that includes viscose rayon.

11. The process of claim 1 wherein the hydroentangled substrate is made using absorbent fiber that includes wood pulp.

12. The process of claim 1 wherein the hydroentangled substrate is made of approximately 50% wood pulp by weight and approximately 50% embedded polymer by weight.

13. The process of claim 1 wherein the wiper sized sheets made of the hydroentangled substrate are comprised of approximately 50% wood pulp by weight and approximately 50% embedded polymer by weight and do not include a glue material.

14. The process of claim 1 wherein the hydroentangled substrate is at least 89 grams per square meter.

15. The process of claim 1 wherein the hydroentangled substrate is at least 80 grams per square meter.

16. The process of claim 1 wherein the partially dried wiper sized sheets ready for packaging have a water weight of between 5% and 15% compared to a weight of the set of more than one clean, unused wiper sized sheets before the washing.

17. The process of claim 1 wherein the step of compressing in aggregate the shipping set of the partially dried wiper sized sheets to impose wrinkles into the partially dried wiper sized sheets includes placing partially dried wiper sized sheets in a blocking machine that reduces a volume of the set of the partially dried wiper sized sheets and induces creases in the partially dried wiper sized sheets before insertion into a shipping container.

18. The process of claim 1 wherein the step of compressing in aggregate the shipping set of the partially dried wiper sized sheets to impose wrinkles into the partially dried wiper sized sheets includes placing the shipping set of partially dried wiper sized sheets in the shipping container and compressing the shipping set of partially dried wiper sized sheets within the shipping container.

19. The process of claim 1 wherein the shipping container is a bag that is sealed after insertion of a set of partially dried wiper sheets but has a set of at least one breather hole to allow air to enter and leave the bag after being sealed.

20. A process to create a manufactured cloth wiper, the process comprising:

obtaining a set of more than one clean, unused wiper sized sheets of made of a hydroentangled substrate of absorbent fiber and embedded polymer;

washing the wiper sized sheets in water with a mildew inhibitor; the step of washing including agitation of the wiper sized sheets followed by draining the water and mechanically extracting water from the wiper sized sheets;

creating partially dried wiper sized sheets by drying the wiper sized sheets while the wiper sized sheets tumble within a dryer;

packaging the partially dried wiper sized sheets as manufactured cloth wipers in a shipping container that is not air tight so that the partially dried wiper sized sheets can continue to dry while protected with mildew inhibitor; and wherein the partially dried wiper sized sheets ready for packaging have a water weight of between 5% and 15% compared to a weight of the set of more than one clean, unused wiper sized sheets before the washing.

21. A process to create a manufactured cloth wiper, the process comprising:

obtaining a set of more than one clean, unused wiper sized sheets of made of a hydroentangled substrate of absorbent fiber and embedded polymer;

washing the wiper sized sheets in water with a mildew inhibitor; the step of washing including agitation of the wiper sized sheets followed by draining the water and mechanically extracting water from the wiper sized sheets;

creating partially dried wiper sized sheets by drying the wiper sized sheets while the wiper sized sheets tumble within a dryer;

compressing the partially dried wiper sized sheets to impose wrinkles into the partially dried wiper sized sheets;

placing partially dried wiper sized sheets in a blocking machine that reduces a volume of the partially dried wiper sized sheets and induces creases in the partially dried wiper sized sheets before insertion into a shipping container;

packaging the partially dried wiper sized sheets as manufactured cloth wipers in the shipping container that is not air tight so that the partially dried wiper sized sheets can continue to dry while protected with mildew inhibitor; and wherein the shipping container contains manufactured cloth wipers that have wrinkles and a cloth-like appearance and softer feel than the set of more than one clean, unused wiper sized sheets made of the hydroentangled substrate used as inputs to this process.

22. A process to create a manufactured cloth wiper, the process comprising:

obtaining a set of more than one clean, unused wiper sized sheets of made of a hydroentangled substrate of absorbent fiber and embedded polymer;

washing the wiper sized sheets in water with a mildew inhibitor; the step of washing including agitation of the wiper sized sheets followed by draining the water and mechanically extracting water from the wiper sized sheets;

creating partially dried wiper sized sheets by drying the wiper sized sheets while the wiper sized sheets tumble within a dryer;

packaging the partially dried wiper sized sheets as manufactured cloth wipers in a shipping container that is not air tight so that the partially dried wiper sized sheets can continue to dry while protected with mildew inhibitor; and wherein the shipping container is a bag that is sealed after insertion of a set of partially dried wiper sheets but has a set of at least one breather hole to allow air to enter and leave the bag after being sealed.

* * * * *